US007712508B2

(12) United States Patent
Huang

(10) Patent No.: US 7,712,508 B2
(45) Date of Patent: May 11, 2010

(54) COMBINATION TYPE TAPE DISPENSER

(76) Inventor: Harrison Huang, No. 23, Lin T'So Rd., Sheng Kang Hsian, Taichung Hsien (TW)

( * ) Notice: Subject to any disclaimer, the term of this patent is extended or adjusted under 35 U.S.C. 154(b) by 512 days.

(21) Appl. No.: 11/758,349

(22) Filed: Jun. 5, 2007

(65) Prior Publication Data

US 2008/0283195 A1 Nov. 20, 2008

(51) Int. Cl.
*B65H 35/07* (2006.01)

(52) U.S. Cl. ..... 156/527; 156/577; 156/579

(58) Field of Classification Search ..... 156/523, 156/527, 574, 577, 579
See application file for complete search history.

(56) References Cited

U.S. PATENT DOCUMENTS 6,065,520 A * 5/2000 Lee et al. ..... 156/530
7,069,971 B1 * 7/2006 Sheng ..... 156/577
7,207,368 B1 * 4/2007 Lyman, Jr. ..... 156/523

* cited by examiner

*Primary Examiner*—Mark A Osele
(74) *Attorney, Agent, or Firm*—Browdy and Neimark, PLLC

(57) ABSTRACT

A combination type tape dispenser includes a first member having a cutter and a first tape roll mount, and a second member having a second tape roll mount. The first member and the second member is manipulative to be combined and separated. When the first member and the second member are combined, the first member and the second member form a big tape dispenser to mount a big tape roll on the second tape roll mount and cut a tape of the big tape roll by the cutter. When the first member and the second member are separated, the first member forms a small tape dispenser to mount a small tape roll on the first tape roll mount and cut a tape of the small tape roll by the cutter.

12 Claims, 3 Drawing Sheets

COMBINATION TYPE TAPE DISPENSER

BACKGROUND OF THE INVENTION

1. Field of the Invention

The present invention relates generally to a tape dispenser, and more particularly to a combination type tape dispenser, which may dispense two sizes of tape rolls.

2. Description of the Related Art

Conventional tape dispensers only dispense single size of tape roll. Some conventional tape dispensers may dispense various tape rolls by replacing the tape reels. This kind of tape dispenser basically has a constant size so that there will be a small dispenser with a huge tape roll or a huge dispenser with a small tape roll.

SUMMARY OF THE INVENTION

The primary objective of the present invention is to provide a combination type tape dispenser, which dispenses various sizes of tape rolls.

The secondary objective of the present invention is to provide a combination type tape dispenser, which the size of the dispenser will change to match the tape roll.

According to the objectives of the present invention, a combination type tape dispenser includes a first member having a cutter and a first tape roll mount, and a second member having a second tape roll mount. The first member and the second member are manipulative to be combined and separated. When the first member and the second member are combined, the first member and the second member form a big tape dispenser to mount a big tape roll on the second tape roll mount and cut a tape of the big tape roll by the cutter. When the first member and the second member are separated, the first member forms a small tape dispenser to mount a small tape roll on the first tape roll mount and cut a tape of the small tape roll by the cutter.

DETAILED DESCRIPTION OF THE INVENTION

Figure 1:
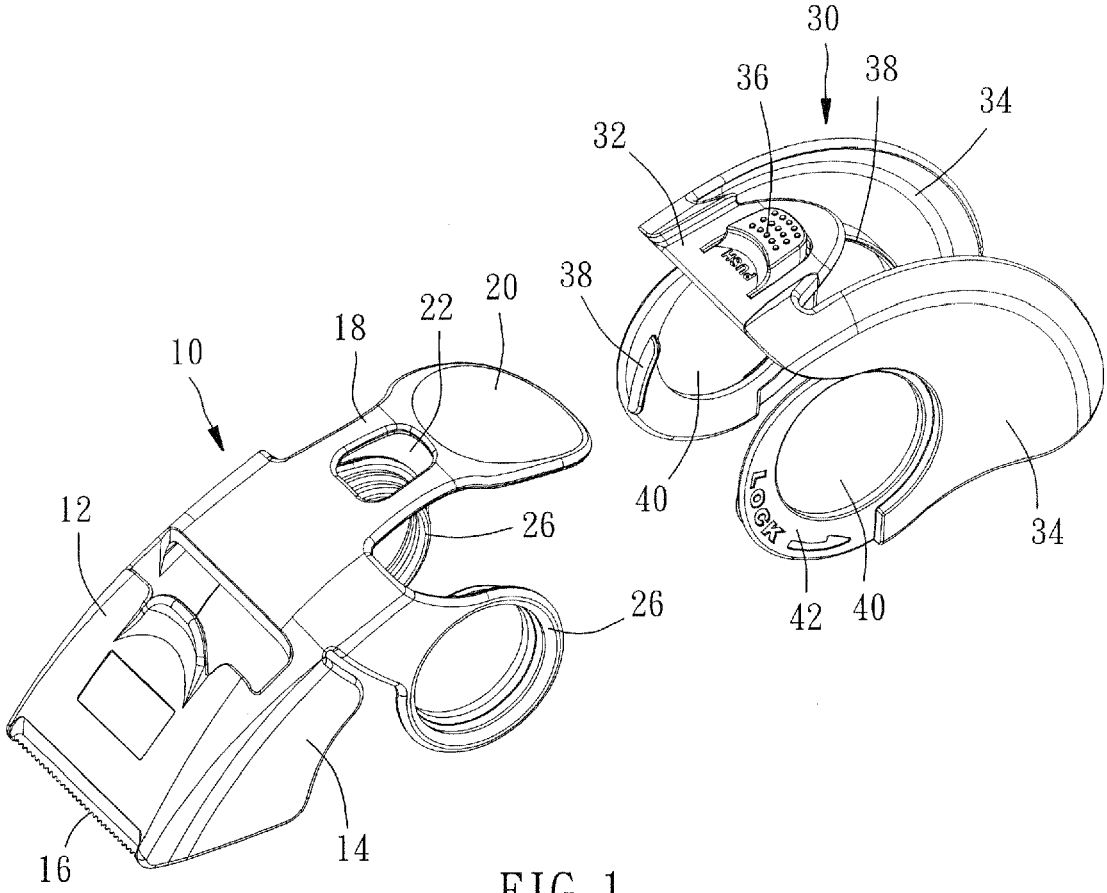
FIG. 1 is an exploded view of a preferred embodiment of the present invention.

As shown in FIG. 1, a combination type tape dispenser of the preferred embodiment of the present invention includes a first member 10 and a second member 30.

The first member 10 includes a top portion 12 and two parallel lateral walls 14 on opposite sides of the top portion 12. The top portion 12 is fixed with a cutter 16 at a front thereof and has a tongue 18 at a rear thereof. The tongue 18 has a mound portion 20 to support user's palm and a bore 22 to be a second coupling portion of the first member 10. Each of the lateral walls 14 has a post 24 at an inner side thereof and a first tape roll mount 26 at a rear portion thereof. Each of the first tape roll mounts 26 has a rim at an inner side to hold a tape roll and to form a first coupling portion of the first member 10 as well.

The second member 30 has a top portion 32 and two lateral walls 34 also. A button 36 is provided on the top portion 32 to form a second coupling portion of the second member 30. Each of the lateral walls 34 has a second tape roll mount 38, which is a two-section curved wall on an inner side thereof, a bore 40 to form a first coupling portion of the second member 30, and an indentation portion 42 around the bore 40 respectively.

Figure 2:
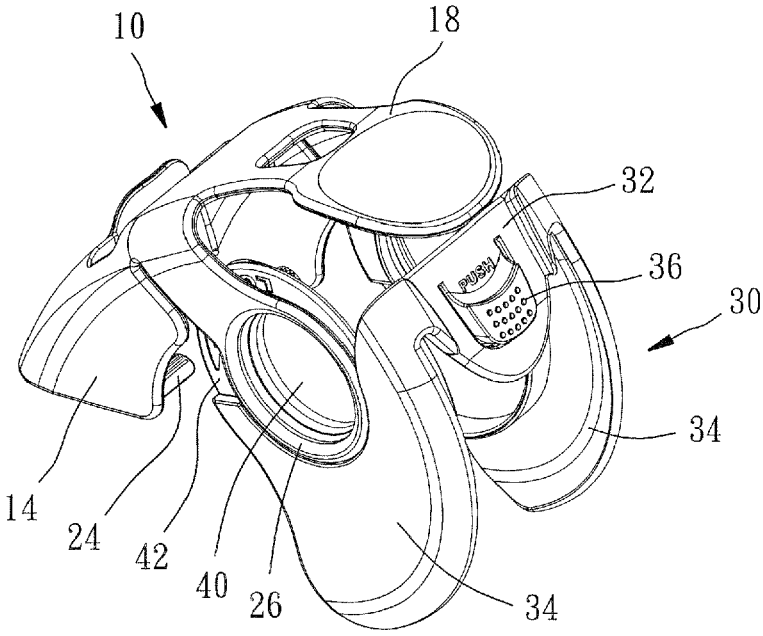
FIG. 2 is a perspective view of the preferred embodiment of the present invention, showing the combining process of the first member and the second member.
Figure 3:
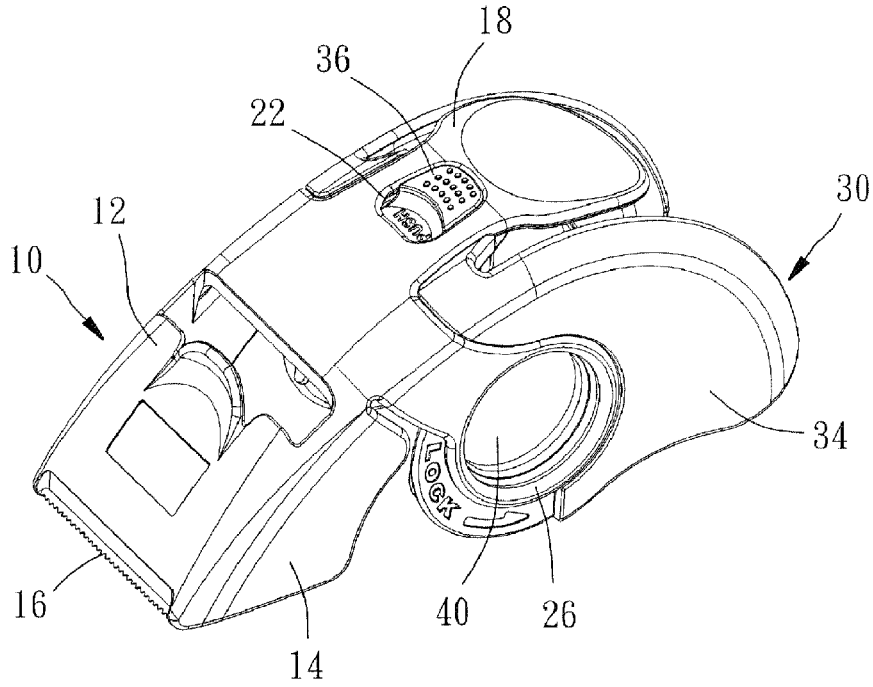
FIG. 3 is a perspective view of the preferred embodiment of the present invention in combination type.
Figure 4:
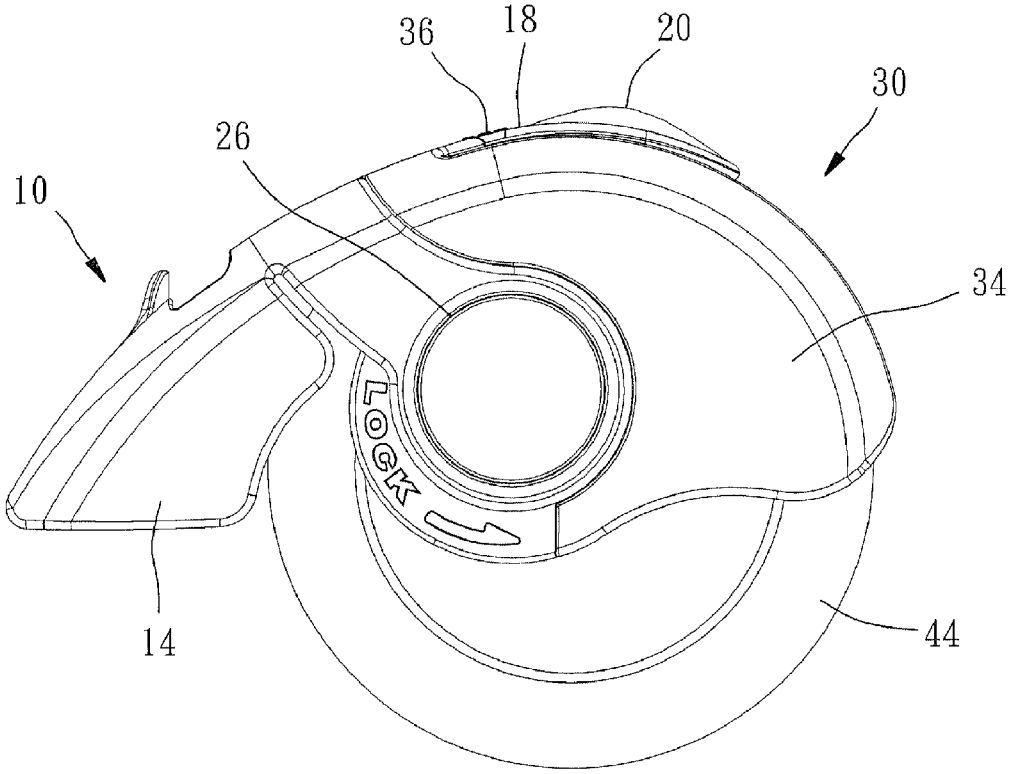
FIG. 4 is a lateral view of the preferred embodiment of the present invention in combination type.
Figure 5:
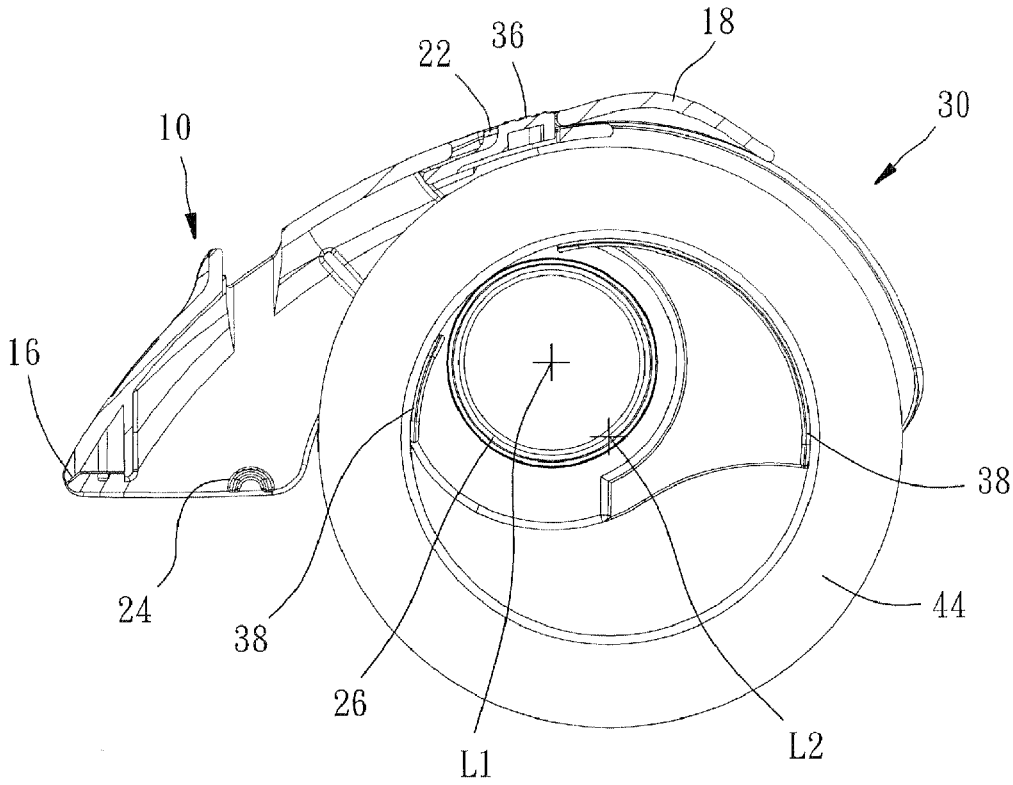
FIG. 5 is a sectional view of FIG. 4.

To dispense a greater tape roll, it has to combine the first member 10 and the second member 30 first. As shown in FIG. 2, user has to engage the first tape roll mounts 26 of the first member 10 with the bores 40 of the second member 30 respectively (engagement of the first coupling portions). The first tape roll mount 26 of the first member 10 are received in the indentation portions 42 of the second member 30 respectively that the lateral walls 14, 34 of the first member 10 and the second member 30 will be even when the first member 10 and the second member 30 are combined. The first member 10 and the second member 30 may be rotated with the first tape roll mounts 26 and the bores 40 to be a center of rotation. Next, rotating the first member 10 or the second member 30 to have the tongue 18 of the first member 18 cross the top portion 32 of the second member 30 and the button 36 engaged with the bore 40 (engagement of the second coupling portions) that the first member 10 and the second member 30 are firmly combined together to form a big tape dispenser, as shown in FIG. 3. Please referring to FIG. 4, and FIG. 5, a big tape roll 44 may be mounted on the second tape roll mount 38 of the big tape dispenser, and a tape (not shown) of the tape roll may be drawn out and crossing the posts 24 to be cut by the cutter 16.

To separate the first member 10 and the second member 30, user only has to press the button 36 for disengage the button 36 and the bore 22 (disengagement of the second coupling portions) that causes the first member 10 and the second member 30 may rotate again, and then press the lateral walls 34 of the second member 30 to disengage first tape roll mounts 26 and the bores 40 that the first member 10 is separated from the second member 30.

Figure 6:
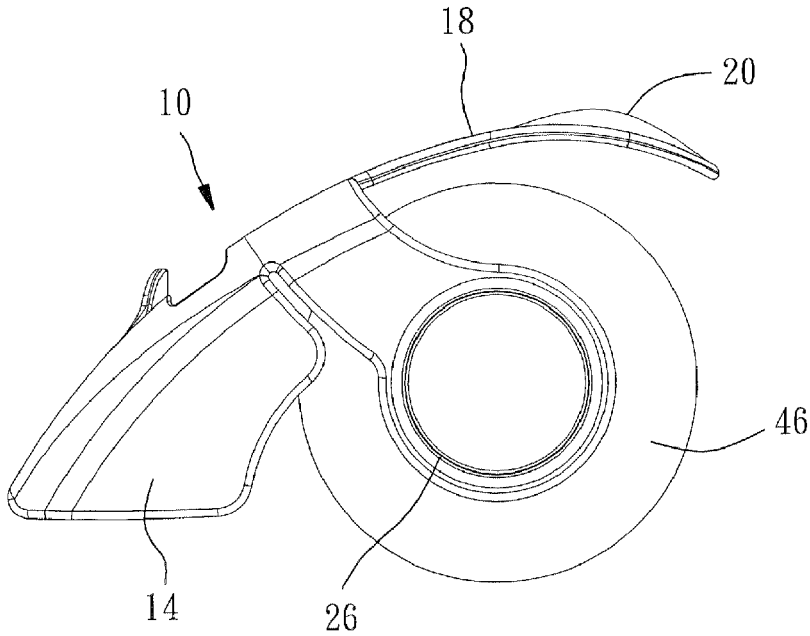
FIG. 6 is a lateral view of the first member of the preferred embodiment of the present invention.

In separation condition, the first member 10 becomes a small tape dispenser that a small tape roll 46, referring to FIG. 6, may be mounted on the first tape roll mounts 26 for free rotation, and a tape (not shown) of the tape roll may be drawn out and crossing the posts 24 to be cut by the cutter 16.

The main character of the present invention is that the first member 10 serves a small tape dispenser to dispense a small tape roll, and the combination of the first member 10 and the second member 30 serves a big tape dispenser to dispense a big tape roll that the size of the dispenser will match the tape roll.

In addition, a center L1 of the first tape roll mount 26 is different from a center L2 of the second tape roll mount 38. In other words, the big tape dispenser and the small dispenser will have different centers of gravity that provide well operation modes respectively.

The description above is a few preferred embodiments of the present invention and the equivalence of the present invention is still in the scope of the claim of the present invention.

What is claimed is:

1. A combination type tape dispenser, comprising:

a first member having a cutter and a first tape roll mount;

a second member having a second tape roll mount; and means for combining a separating the first member and the second member;

wherein when the first member and the second member are combined, the first member and the second member forms a big tape dispenser to mount a big tape roll on the second tape roll mount and cut a tape of the big tape roll by the cutter, and when the first member and the second member are separated, the first member forms a small tape dispenser to mount a small tape roll on the first tape roll mount and cut a tape of the small tape roll by the cutter.

2. The combination type tape dispenser as defined in claim 1, wherein the first member includes a top portion, on a front end of which the cutter is provided, and two lateral walls, on inner sides of which the first tape roll mount is provided to hold the small tape roll between the lateral walls, and the second member includes a top portion and two lateral walls, on inner sides of which the second tape roll mount is provided to hold the big tape roll between the lateral walls.

3. The combination type tape dispenser as defined in claim 2, wherein the top portion of the first member has a tongue at a rear end thereof.

4. The combination type tape dispenser as defined in claim 2, wherein the second tape roll mount includes two curved walls on the inner sides of the lateral walls of the second member.

5. The combination type tape dispenser as defined in claim 2, wherein each of the lateral walls of the second member has an indentation portion.

6. The combination type tape dispenser as defined in claim 1, wherein a center of the first tape roll mount is different from a center of the second tape roll mount.

7. The combination type tape dispenser as defined in claim 1, wherein the first tape roll mount of the first member is a first coupling portion to be engaged with a first coupling portion of the second member.

8. The combination type tape dispenser as defined in claim 7, wherein the first coupling portion of the first member has an annular rim, and the first coupling portion of the second member has a bore.

9. The combination type tape dispenser as defined in claim 1, wherein the means include a pair of first coupling portions and a pair of second coupling portions on the first member and the second member respectively, wherein the first member is pivotally coupled to the second member when the first coupling portions are engaged, and first member is firmly combined with the second member when the first member is rotated to have the second coupling portion engaged.

10. The combination type tape dispenser as defined in claim 9, wherein the first coupling portion of the first member is the first tape roll mount, and the first coupling portion of the second member is a bore.

11. The combination type tape dispenser as defined in claim 9, wherein the second coupling portions are a button and a bore.

12. The combination type tape dispenser as defined in claim 1, wherein a size of the big tape dispenser is significantly greater than a size of the small tape dispenser.

* * * * *